United States Patent [19]

Magil et al.

[11] 4,195,290

[45] Mar. 25, 1980

[54] ELECTRICAL RECEPTACLE FOR USE IN ALARM SYSTEM

[75] Inventors: Paul Magil; William F. Word, III, both of Long Beach, Calif.

[73] Assignee: Paul Alan Magil & Associates, Costa Mesa, Calif.

[21] Appl. No.: 889,786

[22] Filed: Mar. 24, 1978

[51] Int. Cl.[2] ..... G08B 13/02; G08B 21/00

[52] U.S. Cl. ..... 340/568; 174/67; 200/51.09; 339/41; 340/687

[58] Field of Search ..... 340/568, 687; 339/36, 339/37, 40, 41, 42; 200/51.09, 51.1; 174/67

[56] References Cited

U.S. PATENT DOCUMENTS

| | | | |
|---|---|---|---|
| 2,524,250 | 10/1950 | Bierce | 174/67 |
| 2,916,733 | 12/1959 | Hirsch | 340/568 |
| 3,192,518 | 6/1965 | Sliman | 340/568 |
| 3,801,971 | 4/1974 | Stendig et al. | 340/568 |

*Primary Examiner*—Glen R. Swann, III

*Attorney, Agent, or Firm*—Caesar, Rivise, Bernstein & Cohen, Ltd.

[57] ABSTRACT

An electrical power receptacle includes a cover for receipt of power prongs, behind which is located a pair of electric power terminals. A lockout means having a pair of slots therein is located interposed between the cover of the receptacle and the pair of electric power terminals. The lockout means is rotatable between a closed position wherein said lockout means occludes at least one of the slots in the cover to prevent the prongs of the plug from being inserted therein and an open position wherein the slots in the lockout means align with the slots in the cover to enable the prongs of the plug to be inserted therethrough and into electrical communication with the power terminals. A switch is coupled to the lockout means and provides a first electrical signal whenever the lockout means is in the closed position or when the lockout means is in the open position with a plug's prongs inserted within the slots of the receptacle. The switch provides a second signal if the lockout means is in the open position and no plug is within the receptacle. The switch is electrically isolated from the power terminals.

16 Claims, 6 Drawing Figures

FIG. 2
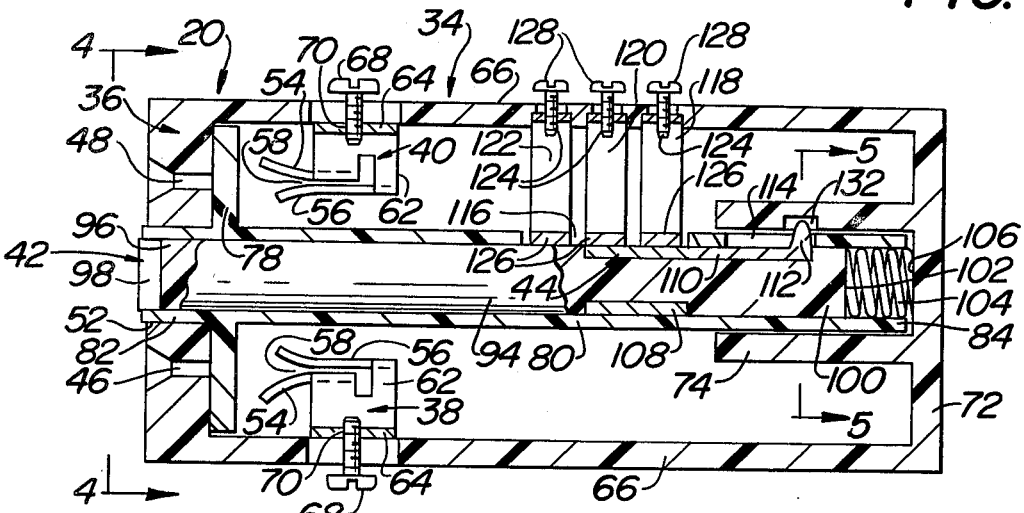
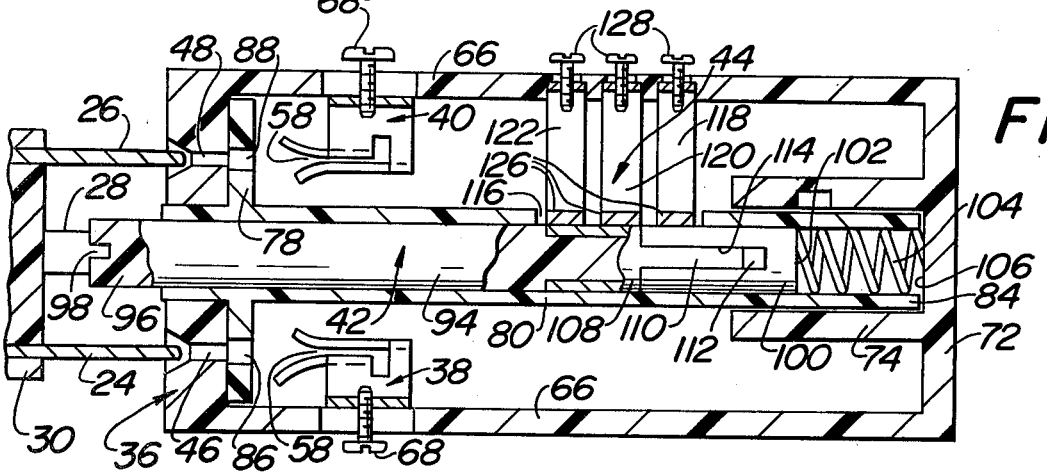
FIG. 3
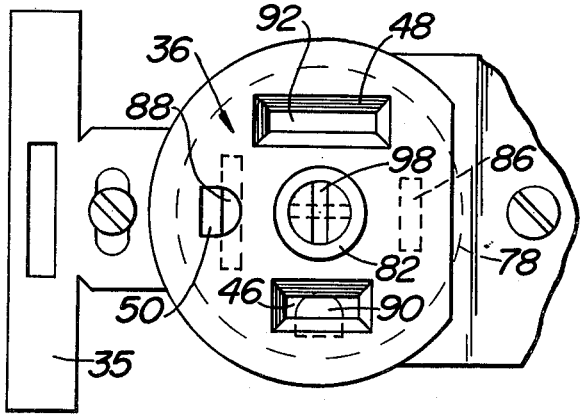
FIG. 4
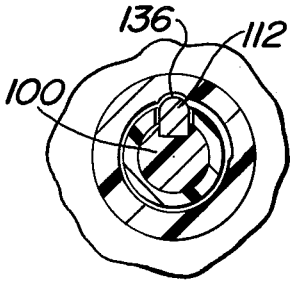
FIG. 5

ELECTRICAL RECEPTACLE FOR USE IN ALARM SYSTEM

FIELD OF INVENTION

This invention relates generally to electrical power receptacles and more particularly to an electrical power receptacle arranged to provide a warning signal upon the removal of an applicance plug therefrom.

Various security devices or apparatus have been disclosed in the patent literature for use in commercial, industrial and residential electric power distribution systems to provide warning signals in the event that an electrical power plug is removed from a monitored receptacle. Such systems find utility in various applications, the most common of which being, to prevent theft of electrical applicances from appliance showrooms, hotels, motels, etc. Other major applications for such systems are to monitor hospital equipment, such as life support apparatus, scientific or laboratory equipment, etc., to insure that the equipment remains connected in the receptacle and to provide a warning signal in the event of accidental or unauthorized disconnection.

DESCRIPTION OF THE PRIOR ART

Examples of prior art plug security systems are found in the following U.S. Pat. Nos. 3,090,948 (Cremer), 3,192,518 (Slimann), 3,289,194 (King), 3,411,150 (Schulein), 3,425,050 (Tellerman), 3,440,636 (slimann), 3,484,775 (Cline), 3,609,742 (Burdick), 3,618,065 (Trip, et al), 3,794,989 (Manley), and 3,919,715 (Stendig). While the devices of the above identified patents ostensibly provide the desired security function, such devices exhibit one or more drawbacks or deficiencies inherent in their construction. For example, many prior art systems entail the use of specially constructed applicance cord plugs. Many of the same, as well as other prior art systems, necessitate the use of additional electrical connection means or of specially constructed electrical junction boxes for receipt of the appliance cord plug. Some systems even necessitate modification of the electrical appliance itself.

Needless to say, the necessity for modifying or retrofitting appliance power cord plugs and/or electrical junction boxes and/or the receptacle disposed therein in order to utilize prior art security systems is a considerable disadvantage, rendering such systems of very limited utility.

Another common characteristic of many prior art systems is that such systems utilize signalling circuitry which is electrically connected to or powered by the power conductors of the electrical receptacle being monitored. The lack of electrical isolation between the power circuitry and the monitoring and signalling circuitry may, in some cases, present potential hazards and even be violative of various building codes relating to equipment grounding.

Other prior art security systems do not appear suitable for multireceptacle applications such as provided by the continuous outlet strips or raceway-type structures that are commonly used today in showrooms, stores, etc.

Accordingly, it is a general object of the instant invention to overcome the disadvantages of the prior art.

It is a further object of this invention to provide a security receptacle of simple construction and comparable size to prior art receptacles but capable of providing a signal indicative of the removal of a cord plug therefrom.

It is still a further object of the instant invention to provide a simple and low cost security receptacle for providing power to a conventional electrical power cord plug and for providing a signal indicative of the removal of the plug therefrom.

It is still a further object of the instant invention to provide a security receptacle including lockout means for precluding a plug from being inserted therein.

SUMMARY OF THE INVENTION

It is still a further object of the instant invention to provide the security receptacle having switching means within the receptacle housing for providing a signal to associated indicating means to indicate the removal of a plug therefrom and which switching means is electrically isolated from the power circuitry of said receptacle.

These and other objects of the instant invention are achieved by providing a receptacle for receipt of at least one pair of prongs and one pair of electrical power terminals located behind the fascia and aligned with the openings. Lockout means and switching means are located within the housing. The lockout means is moveable between a closed position in which it occludes at least one of the openings to prevent the prongs of an electrical plug from being inserted therethrough and into electrical communication with the power terminals and an open position, wherein the lockout means does not occlude the openings to enable the prongs of the plug to be inserted therethrough and into electrical communication with the power terminals. The switching means is electrically isolated from the power terminals and provides a first signal indicating the presence of a plug within the receptacle if the lockout means is in the open position and for indicating the existence of the lockout means in the closed position. The switching means provides a second signal indicating the absence of a plug within the receptacle if the lockout means is in the open position.

BRIEF DESCRIPTION OF THE DRAWING

Other objects and many of the attendant advantages of this invention will be readily appreciated as the same becomes better understood by reference to the following detailed description when considered in connection with the accompanying drawings, wherein:

FIG. 2 is a sectional view taken along line 2—2 of FIG. 1, but showing the receptacle in its lockout or closed position; and, FIG. 3 is a sectional view also taken along line 2—2 of FIG. 1, but showing the receptacle in its open position;

FIG. 4 is an end view taken along line 4—4 of FIG. 2; and,

FIG. 5 is a sectional view taken along line 5—5 of FIG. 2.

Referring now to various figures of the drawings wherein like reference characters refer to like parts, there is shown generally at 20 a security receptacle in accordance with the instant invention.

Figures 1, 1A:
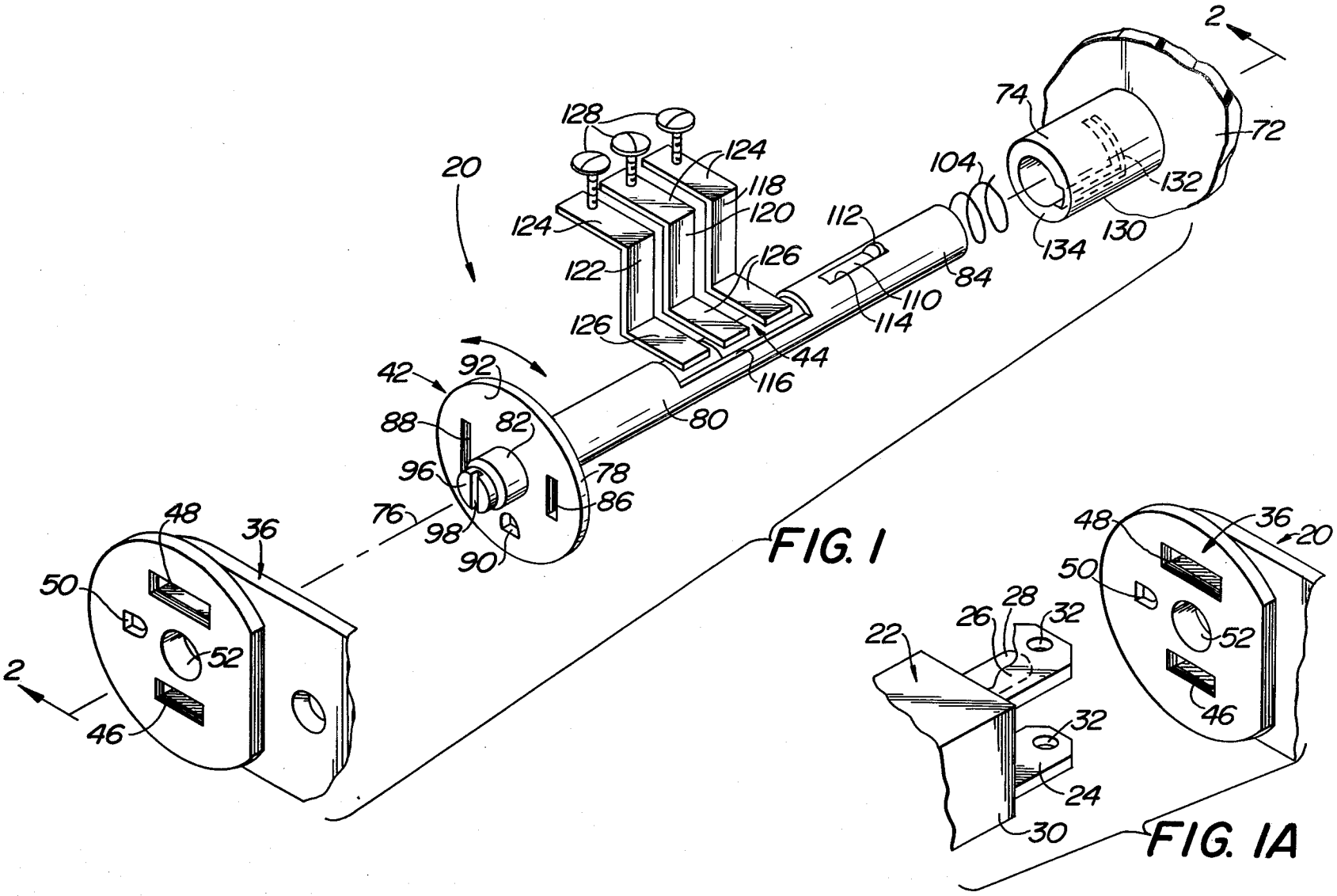
FIG. 1 is an exploded perspective view of a portion of the security receptacle of the instant invention.
FIG. 1A is a perspective view of a portion of the receptacle shown ready for receipt of a conventional cord plug therein.

The receptacle 20 is a duplex type unit having two identical receptacle portions (only one of which is shown) and each is arranged for receipt of a conventional, pronged power plug 22, like that utilized to provide nominal 120 volt A.C. power to appliances and other electrically operated apparatus and equipment.

DESCRIPTION OF THE PREFERRED EMBODIMENT

While various types of conventional pronged plugs can be used with this invention, the plug shown in FIG. 1A represents a common type used today, namely, the grounded plug. To that end, as can be seen herein, the plug 22 comprises a "hot" conductor blade 24, a "neutral" conductor blade 26 and a ground prong 28. The blades and ground prong all extend parallel to one another out of a housing 30. As is conventional practice, the hot and neutral blades 24 and 26, respectively, each include a hole 32 at their free end and the hot blade is somewhat narrower than the neutral blade. The blades and the ground prong are arranged to be inserted within corresponding slots and a hole, respectively, in the receptacle 20 to provide 120 volt A.C. power from mains (not shown) to the appliance (not shown) to which the plug is connected.

The receptacle 20 of the instant invention includes a housing 34 (FIG. 2), which, as will be described later, is of generally conventional construction and includes means for mounting the receptacle in a conventional electrical junction box (not shown). The mounting means is conventional and comprises a pair of flanged mounting straps 35, (FIG. 4) one on each end of the housing 34. Each strap includes an opening through which a screw extends for securement to the junction box. The housing 34 is formed by plural sidewalls 66, a backwall 72 and is totally enclosed by front cover or fascia 36. A pair of electrical power terminals 38 and 40 are mounted within the housing. Lockout means 42 and switching means 44 are also located within the housing 34.

As can be seen clearly in FIGS. 1 and 1A, the fascia 36 is of generally conventional construction and appearance and includes a short slot 46, a long slot 48 and a flatted circular slot 50, for receipt of the hot blade 24, the neutral blade 26, and the ground prong 28, respectively, of the plug 22. However, what sets the fascia 36 apart from a conventional receptacle fascia is a central hole 52. The hole 52 serves as a passageway through which a portion of the lockout means 42 extends, as will be described in detail later.

Turning now to FIGS. 2 and 3, it can be seen that each of the power terminals 38 and 40 is mounted within the housing 34 and behind the slots 46 and 48, respectively. The terminals 38 and 40 are each of conventional construction. To that end, each includes a pair of resilient fingers or contacts 54 and 58 mounted on an upstanding arm 62. Each finger terminates in a curved free end. The fingers are spaced slightly from each other to define a flared mouth 58 therebetween. The base 64 of the upstanding arm of each terminal is fixedly secured, in a conventional manner, to a respective side wall 66 of the housing. Each terminal is formed of an electrically conductive metal. A screw 68 extends through an opening in the side wall 66 of the housing 34 and a threaded opening 70 in the base 64 of each terminal and serves as the means for connecting the associated electrical power conductors, which provide the electricity to the circuit to which the receptacle is connected, and to the associated power terminal. For the sake of drawing simplicity the power conductors are not shown.

The lockout means 42 will be described in detail later. Suffice for now to say that such a means is arranged to be moved into either of two rotational positions. One position is referred to as the lockout or closed position and the other position is referred to as the open position. In the closed position the lockout means blocks or occludes the slots 46, 48 and 50 in the fascia 36, while in the open position, the slots are not blocked.

As can be seen in FIG. 3, the mouth 58 of the terminal 38 is axially aligned with the short slot 46 in the fascia and the mouth 58 of the terminal 40 is axially aligned with the long slot 48. Accordingly, when the lockout means is in the open position, that is, not blocking the slots, a plug can be inserted into the receptacle 20 with its hot blade 24 passing through the short slot 46 and into electrical engagement with the mouth of the terminal 38, and its neutral blade 26 passing through the long slot 48 and into electrical engagement with the mouth of the terminal 40. Since terminal 38 and terminal 40 are connected to the power conductors of the building's service, via their associated screws 68, electrical power is coupled, via the receptacle 24 to the plug 22 and hence to the appliance or equipment attached thereto. The ground prong 28 of the plug extends through the flatted circular slot 50, into the housing 34 and into electrical engagement with a ground terminal (not shown) mounted within the housing.

The housing 34, in addition to including the side walls 66 and mating with front cover or fascia 36, also includes a rear wall 72. In accordance with conventional practice, the housing 34 is formed of electrically insulative material, such as molded plastic.

As can be seen in FIGS. 1 and 3 a hollow tubular extension or seat 74 projects normally from the inside surface of the rear wall 72 of the housing and toward the fascia 36. The seat is formed of a circular side wall which is concentric with the axis passing through the center of the opening 52 in the fascia. This axis is shown by the broken line in FIG. 1 and identified by reference numeral 76.

The lockout means 42 basically comprises a lockout disc 78 and a tubular sleeve 80. The disc is in the form of a planar circular flange projecting radially outward from the sleeve 80 adjacent the front end 82 thereof. The outside diameter of the tubular sleeve 80 at the front end 82 and the rear end 84 is just slightly smaller than the diameter of the opening 52 in the fascia 36 and the inside diameter of the seat 74.

The lockout means 42 is disposed and mounted within the housing 34 so that its disc 78 is interposed between the rear of the fascia 36 and the power conductor terminals 38 and 40. To that end, the forward end 82 of the tubular sleeve 80 is located within the opening 52 in the fascia 36 and the rear end 84 of the sleeve is located within the seat 74. When disposed thusly, the lockout means 42 is rotatable about the axis 76.

As can be seen in FIG. 1 the disc 78 of the lockout means includes plural slots therein, namely a short slot 86, a long slot 88, and a flatted circular slot 90. The short slot 86 in the disc corresponds in size to the short slot 46 in the fascia, the long slot 88 in the disc corresponds in size to the long slot 48 in the fascia and the flatted circular slot 90 in the disc corresponds in size to the flatted circular slot 50 in the fascia. The slots 86, 88 and 90 are located on the disc 78 such that when the disc is rotated 90 degrees clockwise from the position shown in FIG. 1 to the position shown in FIG. 3, the slots 86, 88 and 90 in the disc 78 are aligned with slots 46, 48 and 50, respectively, in the fascia. It is this aligned position which has been identified heretofore as the open position of the lockout means. The closed position of the lockout means is the position shown in FIGS. 2 and 4.

As should be apparent by reference to FIGS. 2 and 4 when the lockout means is in the closed position, a portion of the disc 78, located between the slots 86 and 88 and denoted by the reference numeral 92, completely blocks or occludes the long slot 48 in the fascia 36, with partial blockage or occlusion similarly introduced behind short slot 46 and flatted circular slot 50 in the fascia. This blockage effectively precludes the insertion of the prongs of the plug 22 into the receptacle 20 for contact with the conductor terminals therein.

As shown clearly in FIGS. 1, 2 and 4, the lockout means 42 also includes a cylindrical rod or shaft 94 located within the interior of the tubular sleeve 80. The front end of the central rod 94, denoted by the reference numeral 96, extends slightly out of the end 82 of the sleeve 80 and hence projects slightly out of the fascia 36. A diametric slot 98 is cut in the end face 96 of the shaft 94. The shank of the rod 94 is denoted by the reference numeral 10 and terminates in a flat end 102.

As will be described in detail hereinafter, the shaft 94 is rotatable with the sleeve 80 between the open and closed positions and is also reciprocable within the tubular sleeve 80 between a retracted position, like that shown in FIG. 2 wherein the rod is almost fully retracted within the sleeve 80, and an extended position, like that shown in FIG. 3 wherein a portion of the end 96 of the rod 94 extends substantially beyond the end 82 of the sleeve 80. A helical compression spring 104 is located within the rear end of the tubular sleeve and interposed between the rear wall of the housing 72 and the end 102 to move the rod to the extended position shown in FIG. 3.

Both the tubular sleeve 80 and the central rod 94 are formed of an electrically insulative material. The rod 94, however, includes an electrically conductive annular ring 108 extending about the periphery of the rod in a shank portion thereof. The ring also includes an integral, longitudinal extending arm 110. The ring 108 and the arm 110 are recessed within the periphery of the rod 94 so that their outer surfaces are flush with the outer periphery of the rod. The end of arm 110 terminates in an upstanding nib 112 which projects radially outward from the axis of the rod 94. The nib is received within and extends through an elongated longitudinal extending slot 114 in the side wall of the tubular sleeve 80. The location of the nib 112 within the slot 114 guides the rod 94 for reciprocation within the tubular sleeve 80 between the extended and retracted positions.

The tubular shaft 80 also includes an enlarged opening 116 in its side wall and located forward of slot 114. The opening 116 is of greater width than the width of the conductive ring 108.

The conductive ring 108 serves as moveable contactor for the switching means 44. The switching means 44 also includes three electrically conductive contact blades 118, 120 and 122. As can be seen clearly in FIG. 1, each of the blades is of generally Z-shaped construction including a top portion 124 which is fixedly secured to the side wall 66 of the housing 34. The bottom of each of the contact blades 118, 120 and 122 is denoted by the reference numeral 126 and extends generally parallel to the portion 124. Each of the blades is biased so that the underside of its free end extends into the sleeve's opening 116 and into contact with peripheral portion of the rod 94 exposed thereby. The width of the contact ring 108 is approximately equal to the width of any two adjacent contact blades and the space interposed therebetween. Accordingly, when the rod 94 is in the retracted position, shown in FIG. 2, the moveable contact ring 108 bridges and electrically interconnects the contact blades 118 and 120, while blade 122 is isolated therefrom. When the rod 94 is in the extended position, like that shown in FIG. 3, the contact ring 108 bridges the contact blades 120 and 122, thereby electrically interconnecting them, while blade 118 is isolated therefrom.

Each contact blade 118, 120 and 122 includes a threaded opening in which a respective screw 128 is located. The screws 128 serve as the means for connecting the switching means 44 to remote signalling means in the form of a relay (not shown) for providing signals indicative of the position of the rod 94. To that end, the "relay" includes a normally closed contact which is connected, via a conductor (not shown) and the screw 128, to the contact blade 122. The "relay" also includes a common contact which is connected, via another conductor (not shown) and a screw 128, to the contact blade 120. The "relay" also includes a normally open contact which is connected, via another conductor (not shown) and a screw 128, to the contact blade 118. The contacts of the relay are connected to any suitable alarm or indicating circuitry to provide either a visual, e.g., light signal, or an audible, e.g., buzz, bell, etc., signal in response to the condition of its contacts.

When the lockout means 42 is in the open position and a plug 22 is inserted into the receptacle 20 the housing or body 30 of the plug makes contact with the free end 96 of the rod 94 to force the rod against the resistance of the spring 104 inward to the retracted position like that shown in FIG. 2. As will be described in detail later, the rod is also in the retracted position when the lockout means is moved to the closed position. Accordingly, whenever the rod 94 is in the retracted position, which indicates that the lockout means is in the closed position, or that the lockout means is in the open position, but a plug is inserted in the receptacle, the moveable contactor 108 bridges the contact blades 118 and 120, thereby electrically interconnecting the normally open contact and the common contact of the connected relay, whereupon the indicating means indicates the existence of either of those two "non-alarm" conditions.

Should the plug be removed from the receptacle, as could occur during a theft of the applicance, or as could occur accidentally, the movement of the plug housing 30 of the plug out of engagement with the end 96 of the shaft 96 enables the spring 104 to urge the shaft to the extended position shown in FIG. 3. This action causes the moveable contactor 108 of the central shaft 94 to bridge the end 126 of the contact blades 120 and 122. Accordingly, the common and normally closed contacts of the relay are interconnected and the indicating means provides a signal indicative of this "alarm" condition.

As can be seen in FIGS. 1, 2 and 3, the circular sidewall forming the seat 74 includes two elongated tracks or raceways 130 and 132. The raceway 130 extends longitudinally along the inside surface of the seat 74 from the front end 134 rearward until it merges with raceway 132. The raceway 132 extends about the inner periphery of the seat for 90°. The raceway 130 is arranged to receive the nib 112 of the rod 94 which extends through the slot 114 in the tubular sleeve 80 to permit the rod 94 to be reciprocated up and down the sleeve between the extended and retracted positions. The raceway 132 is arranged to receive the nib 112 after it reaches the rear end of the raceway 130 to enable the lockout means to be rotated between the open and closed positions.

As can be seen in FIG. 5, the raceway 132 includes a lobed portion 136 at the end opposing its juncture with raceway 130. The lobed portion serves as a detent for holding the nib in place therein and not in an intermediate portion of the raceway.

As should be appreciated by reference to FIGS. 1 and 3, when the lockout means is in the open position, that is, rotated so that the slots therein are aligned with the slots in the fascia, the nib 112 is axially aligned with the raceway 130. The application of a force on the end 96 of the rod 94, such as occurs when a plug is inserted, causes the rod 94 to slide down the tubular sleeve 80 toward the retracted position, with the nib 112 sliding down the raceway 130. When it is desired to lock out the receptacle, a bladed tool, such as a screwdriver, is inserted within slot 98 to force the rod 94 to the retracted position and then to rotate the shaft 94 about axis 76 counterclockwise, whereupon the nib 112 enters the raceway 132. Continued rotation of the rod 94 causes the nib to move down the raceway 132 and into the lobe 136. This action locks the rod 94 in place at the closed rotational position. Since nib 112 extends through the elongated shaft 114 in the tubular shaft 80, the rotation of the shaft 94 to the closed position in a concommitant rotation of the sleeve 80, whereupon the disc 78 of the lockout means occludes the slots in the fascia.

When it is desired to open the receptacle, that is, to move the lockout means from the closed position to the open position, the rod 94 is rotated clockwise, via application of a clockwise rotational force to slot 98. This action rotates the rod and causes the nib 112 to move along the raceway 132 from lobe portion 136 to the interface of raceway 130 and 132. The entrance of nib 112 into raceway 130 enables the compressed spring 104 to force the rod 94 to the extended position shown in FIG. 3 when the force applied to rotate the rod has been removed.

It should be pointed out at this juncture that the device of the instant invention can be configured as a duplex receptacle, like shown, i.e., containing two individual receptacles 20 within a single housing, or in other conventional arrangements, e.g., a single receptacle, a continuous outlet strip or raceway comprising a plurality of individual receptacles mounted at spaced centers along the housing strip, with the switch means of each of the receptacles being individually circuited or connected in series, parallel or series/parallel, etc.

It should be appreciated from the foregoing that the security receptacle of the instant invention is a simple and inexpensive, self-contained electro-mechanical device for conveying institutional or residential 120 volt A.C. service to standard grounded or ungrounded cord plugs. The device realizes, through its components, an electrical switching capability exclusively associated with the actual presence of a cord plug within the receptacle. To that end the switching means of a receptacle is operated by, and maintained in operation by, the insertion of, and the continued presence of a conventional cord plug in the receptacle. The removal of the plug, whether accidental or intentional, results in the switching means initiating the production of an alarm signal. The mechanical lockout means not only prohibits the insertion of applicance cord plug into the receptacle when in its closed position, it also insures that the switching means does not initiate the production of an alarm signal.

Furthermore, the lockout means has major application in multi-receptacle configurations, such as a continuous outlet strip, to disable or lock out any individual receptacle(s) which is not needed, to prevent such receptacle(s) from providing a warning signal when not used, while enabling the receptacles which are used to provide a warning signal indicative of an accidental or unauthorized removal of the plug therefrom. This feature is of considerable importance in retail merchandising applications since such applications frequently do not make use of all of the available receptacles.

By virtue of its low parts count, simplicity and compactness of its operating components, the receptacle of the instant invention can be housed in a housing of comparable size to commercially available receptacles. This feature renders the receptacle of the instant invention suitable for mounting in conventional electrical junction boxes without modification thereof.

Furtherstill, owing to the construction of the switching and lockout means of the receptacle, at all times the switching means and the external circuitry connected thereto, e.g., relays, indicating circuits, etc., are electrically isolated from 120 volt A.C. service and associated electrical system ground.

Without further elaboration, the foregoing will so fully illustrate our invention that others may, by applying current or future knowledge, readily adapt the same for use under various conditions of service.

We claim:

1. A receptacle for receipt of at least one electrical plug having at least two prongs, said receptacle comprising a face portion including at least one pair of openings and at least one pair of electric power terminals located behind the face portion, each pair of terminals aligned with a corresponding pair of openings, lockout means and switching means, said lockout means being moveable between a closed position in which said lockout means occludes at least one of an associated pair of openings to prevent the prongs of an electrical plug from being inserted therethrough and into electrical communication with the power terminals and an open position wherein the lockout means does not occlude either opening, to thereby enable the prongs of the plug to be inserted therethrough and into electrical communication with the power terminals, said switching means being electrically isolated from said power terminals and providing a first signal indicating either the presence of a plug within the associated pair of openings (if the lockout means is in the open position) or indicating the existence of the lockout means in the closed position.

2. The receptacle of claim 1 wherein the switching means provides a second signal indicating the absence of a plug within the receptacle if the lockout means is in the open position.

3. The receptacle of claim 2 wherein said lockout means includes a pair of passageways therein which are aligned with the associated openings in the face when the lockout means is in the open position and which are not aligned with said openings when the lockout means is in the closed position.

4. The receptacle of claim 3 wherein the lockout means includes a first portion being reciprocable along a first axis toward and away from the face and also rotatable about said first axis and a second portion having said passageways therein and being rotatable with said first portion about said axis, the presence of a plug within the receptacle when the second portion of the lockout means is in the open position causing said first portion of the lockout means to move away from the face to a retracted position, to thereby cause the switching means to provide said first signal, the absence of said plug within the receptacle when the second portion of the lockout means is in the open position causing the first portion of the lockout means to move toward the face to an extended position to thereby cause the switch means to provide the second signal.

5. The receptacle of claim 4 wherein the first portion of the lockout means is moved to the retracted position to enable the first and second portions of the lockout means to be rotated to the closed position.

6. The receptacle of claim 5 wherein the lockout means includes a projection extending out of the face, said projection being depressed by the plug to cause the first portion of the lockout means to move to the retracted position when the second portion of the lockout means is in the open position, whereupon the first signal is provided by the switching means.

7. The receptacle of claim 6 wherein said lockout means includes spring means, acting in opposition to the movement of the first portion of the lockout means to the retracted position, to automatically move the first portion of the lockout means to the extended position if the plug is withdrawn when the second portion of the lockout means is in the open position, whereupon the second signal is provided by the switching means.

8. The receptacle of claim 7 wherein the switch means comprises an electrical contact mounted on said first portion of the lockout means.

9. The receptacle of claim 8 wherein the first portion of the lockout means comprises a rod extending coaxially along the first axis and upon which the electrical contact is mounted.

10. The receptacle of claim 9 wherein the switch means additionally comprises at least one electrical contactor, the contact on the rod being arranged to be brought into electrical contact with the contactor to provide a signal.

11. The receptacle of claim 10 wherein the second portion of the lockout means comprises a disc through which said passageways extend and an elongated tubular sleeve through which said rod extends.

12. The receptacle of claim 11 wherein said tubular sleeve includes an opening into which said electrical contactor extends for engagement with the contact on said shaft.

13. The receptacle of claim 12 wherein said rod includes a radially extending nib and wherein said tubular sleeve includes a longitudinally extending slot in which said nib is disposed.

14. The receptacle of claim 13, said lockout means additionally comprising a hollow seat for receipt of said tubular sleeve and including a first slot therein into which said radially projecting nib extends to permit the rod to be reciprocated between the retracted and extended positions and a second slot into which said nib extends to enable the lockout means to be rotated between the open and closed positions.

15. The receptacle of claim 14 wherein said second slot includes a lobed end, said lobed end locking the lockout means in the closed position.

16. The receptacle of claim 15 wherein said projection includes a slot at the end thereof for receipt of the blade to affect the rotation of said rod.

* * * * *